US005217708A

United States Patent [19]

Pinkney

[11] Patent Number: 5,217,708

[45] Date of Patent: Jun. 8, 1993

[54] CAPSICUM LACHRYMATOR

[75] Inventor: Barry D. Pinkney, Jefferson, Ohio

[73] Assignee: Defense Technology Corporation of America, Casper, Wyo.

[21] Appl. No.: 831,593

[22] Filed: Feb. 5, 1992

[51] Int. Cl.[5] ..... A61K 9/12; A01N 25/06; C09K 3/30

[52] U.S. Cl. ..... 424/45; 424/43; 514/627; 514/890; 514/920; 252/305

[58] Field of Search ..... 252/305; 514/627, 890, 514/918, 920; 424/45, 43; 426/116; 42/1.08

[56] References Cited

U.S. PATENT DOCUMENTS

| | | | |
|---|---|---|---|
| 2,146,715 | 2/1939 | Barker et al. | 167/47 |
| 2,171,701 | 9/1939 | Howett | 424/43 X |
| 3,192,105 | 6/1965 | Wortley et al. | 514/688 X |
| 3,671,637 | 6/1972 | Knowles | 424/322 |
| 3,764,682 | 10/1973 | Knowles | 424/272 |
| 4,160,035 | 7/1979 | Lévai et al. | 424/311 |
| 4,546,112 | 10/1985 | LaHann et al. | 514/627 |
| 4,663,315 | 5/1987 | Hasegawa et al. | 514/86 |
| 4,735,803 | 4/1988 | Katz et al. | 424/195.1 |
| 4,739,990 | 4/1988 | Aguirre et al. | 273/84 R |
| 4,853,413 | 8/1989 | Katz et al. | 514/526 |
| 5,084,097 | 1/1992 | McCreary et al. | 424/43 X |
| 5,178,879 | 1/1993 | Adekunle et al. | 424/484 |

FOREIGN PATENT DOCUMENTS

| | | | |
|---|---|---|---|
| 49-023440 | 6/1974 | Japan | 424/45 |

OTHER PUBLICATIONS

Derwent Abstract 82-61932e/30 (corresponding to FR 2 495 469-A).

*Hackh's Chemical Dictionary*, 4th Ed. (McGraw-Hill Book Co., N.Y., 1984) p. 130.

Patent Abstracts of Japan, C289, vol. 9, No. 160, 51 C 289 (corresponding to J60-34153).

*Primary Examiner*—Robert L. Stoll
*Assistant Examiner*—Daniel S. Metzmaier
*Attorney, Agent, or Firm*—Renner, Otto, Boisselle & Sklar

[57] ABSTRACT

The present invention provides a capsicum containing lachrymator. The lachrymator comprises a nonflammable carrier and capsicum. The nonflammable carrier comprises propylene glycol, ethyl alcohol and water. In one preferred embodiment the lachrymator comprises about 0.3 percent by weight capsicum, about 14.7 percent by weight propylene glycol, about 35 percent by weight ethyl alcohol and about 50 percent by weight water.

11 Claims, 1 Drawing Sheet

CAPSICUM LACHRYMATOR

TECHNICAL BACKGROUND

The present invention concerns a liquid composition for use as a lachrymator. More particularly, the invention concerns a lachrymator produced utilizing capsicum and a nonflammable water based carrier.

BACKGROUND

The prior art provides various compositions which constitute strong irritants to the eyes, mouth and nose of a human and other animals. Such compositions are generally classified as lachrymators. Lachrymators are better known, and commonly referred to as "tear gas" or "riot gas". Lachrymators serve a significant role in society because they allow the police, military and other authorities to control unruly or disruptive persons, including persons under the influence of alcohol or other mind-altering drugs, without having to resort to physical means that may inflict long-term or permanent bodily harm or damage.

Upon application of a lachrymator, the recipient of the lachrymator is overcome by eye, nose and mouth irritation and rendered harmless. More particularly, upon application the recipient is temporarily disabled with intense burning eye pain, blepharospasm, acute bronchitis and respiratory irritation. The prior art provides various means for dispensing or applying lachrymators, such as, for example, pressurized canisters, hand grenades, and munition cartridges.

The need for an aerosol irritant-type spray or lachrymator, for enforcement and defensive purposes, is historic as well as present day evident. Social unrest, demonstrations and rioting during the 1960's caused the extensive use of military type tear gas agents, known typically as the chemicals CN (chloroacetophenone) and CS (ortho-chlorobenzalmalononitrile). These tear gases are actually irritants causing pain and discomfort to the lacrimal glands (tear ducts) and the upper respiratory system. Delivery systems for these agents were comprised mainly of grenades and projectiles, commonly designed as pyrotechnic (burning) type devices. In Wortley, Jr. et al. U.S. Pat. No. 3,192,105 there is disclosed a method of combining CN with a colloidal silica to produce a solid phase form of lachrymator. As disclosed in the '105 patent, this solid phase lachrymator is well suited for use in munitions which disperse the lachrymator by an explosion or similar means.

The search began for more modern methods of delivery/dispersion of tear gas agents, with limited fire potential and more limited (controllable) area coverage. In 1966, Smith and Wesson, through acquisition of General Ordance Equipment Company, introduced CHEMICAL MACE® lachrymator, a liquid based CN chemical formula which was filled into pressurized aerosol spray containers.

CHEMICAL MACE® lachrymator has been the forerunner of all such products since its introduction in 1966. Its use greatly lessens the amount of physical force which might be necessarily applied by a law enforcement officer, corrections officer or security officer when attempting to detain a suspect or disperse a crowd of unruly persons. This type of product fits into the low-end of a "use of force" scale which generally begins with *talking* on the low side, and escalates to *shooting* on the high side. Thus, lachrymators are generally classified as "nonlethal weapons".

The original CHEMICAL MACE® lachrymator formula consisted of trichlorotrifluoroethanes (CFC's 111, 113) and cosmetic kerosene as the carrier agent/solvent, blended with the active ingredient (CN), and pressurized with carbon dioxide as the propellant. This formula has successfully undergone the most extensive scientific and medical test and studies of any similar use type formulation in history. As a result, this formula was used extensively until about 1990. Specifically, beginning about 1990 there was increasing pressure on the chemical industry to phase out ozone depleting substances (i.e., chlorofluorocarbons—CFC's) under the provisions of the Clean Air Act.

The CFC's, which serve as a nonflammable carrier, provide a significant advantage for the lachrymator solution. Specifically, lachrymator solutions that employ a CFC carrier are generally less likely to ignite. More particularly, when a lachrymator is dispensed, there is always the possibility that an open flame or other source of ignition may be present that could ignite the carrier of the mixture resulting in serious bodily harm to both the user and the intended recipient of the lachrymator. Examples of some possible sources of ignition include lit cigarettes or cigars, burning candles or matches, and stoves or other heating devices employed by persons involved in illicit drug use and/or processing. A nonflammable carrier is less likely to ignite when exposed to such sources of ignition and is thus a preferred carrier for use in lachrymators.

Governmental actions in the United States, already taken as a result of the regulatory impact on CFC's, have extended to international proportions resulting for example in the complete banning of CFC's in such countries as Canada. It is likely that CFC's will be totally phased out before the year 2000, and users in the United States are already paying a federal controlled substance use tax.

Manufacturers of CFC substances have been relentless in their search for acceptable substitutes. However, to this date, manufacturers have only been able to provide solvent replacements that do not totally eliminate the problem. The most recent substitute offered is a halogenated fluorocarbon, HCFC-141b. This solvent appeared to be the solution as it complied with the mandate to reduce ozone depleting potential. However, the first danger signal was sounded on Oct. 15, 1991 in a notice which stated that the U.S. Environmental Protection Agency (EPA) did not believe that HCFC-141b was a necessary solvent replacement, and they were taking the position that they had the authority, under the Clean Air Act, to make it unlawful to use HCFC-141b as a solvent replacement. Accordingly, there is currently a need to develop a new carrier system for lachrymators which does not employ CFC's.

Capsicum (also known as cayenne pepper) and its chemical equivalents such as capsaicin ($C_{18}H_{27}NO_2$) have also been utilized to produce lachrymators for many years. Such lachrymators are commonly utilized in the liquid phase and are dispensed from pressurized canisters or bottles. Generally, prior art capsicum containing lachrymators comprise a mixture of capsicum, soybean oil and an alcohol type solvent. Capsicum containing lachrymators are preferred by some users. More particularly, some users believe that capsicum containing lachrymators are more effective than other prior art lachrymators. Some users also believe that capsicum containing lachrymators are particularly effective for use on large animals such as bears. Additionally, some users prefer capsicum because it is a "natural" material as compared to the man-made chemicals CS and CN.

From a physiological standpoint it was noted that CN and CS did not consistently affect persons who were under the influence of alcohol or drugs. Also, from a psychological viewpoint CN and CS did not always affect those persons who were extremely outraged, emotionally disturbed or suffering from neurotic psychological symptoms.

On the other hand, some studies conducted with capsicum have concluded that, if properly dispensed, the capsicum would effect a person in all circumstances including those who were acting under the physiological and psychological influences noted above.

Unfortunately, because the prior art capsicum containing lachrymators also contain carriers which are primarily alcohol, they are considered unacceptable by some users. More particularly, some persons believe the prior art lachrymators may present too much of a fire hazard. Additionally, some persons consider the prior art capsicum containing lachrymators to be unacceptable because they believe the carrier which is primarily alcohol may have an adverse impact upon tests which are utilized to determine the blood-alcohol level of a person exposed to the lachrymator. Thus, there is a need for a carrier system which does not adversely impact upon the blood-alcohol level of a recipient, is suitable for use with capsicum, does not contain CFC's and is nonflammable.

SUMMARY OF INVENTION

The present invention provides a new and useful capsicum containing liquid lachrymator solution which provides various distinct advantages over prior art capsicum containing lachrymators. More particularly, the lachrymator of the present invention includes a nonflammable carrier that is generally acceptable for use around or in the vicinity of potential sources of ignition such as, for example, lit cigarettes or cigars, candles and stoves. Furthermore, the nonflammable carrier does not contain any CFC's. Also, the lachrymator tends not to adversely impact upon the blood-alcohol level of a recipient. Additionally, the lachrymator is suitable for use in conventional pressurized aerosol spray canisters or containers and thus it does not have to be thermally vaporized by a heat source in order to perform properly. Further, the lachrymator is substantially water based yet it is very stable for it does not freeze through a normal range of temperatures and it does not separate over periods of time. The lachrymator is also stable in that it does not spoil or lose its effectiveness over periods of time and there are no adverse interactions or reactions observed as between the various components of the lachrymator. Further, the lachrymator can be disposed of in a conventional manner.

A lachrymator solution made in accordance with the principles of the present invention comprises capsicum and a nonflammable carrier. The nonflammable carrier comprises water, ethyl alcohol and glycol. Preferably, the glycol comprises propylene glycol. As used herein this specification and the claims below the term "capsicum" includes capsicum chemical equivalents such as capsaicin. Also, as used herein this specification and the claims below the term "lachrymator" is intended to be afforded a broad interpretation including any irritant-type product that may be utilized for defense purposes.

In a preferred best mode embodiment the lachrymator solution comprises about 0.3 percent by weight capsicum, about 14.7 percent by weight propylene glycol, about 35 percent by weight ethyl alcohol and about 50 percent by weight water.

The foregoing and other features of the invention are hereinafter more fully described and particularly pointed out in the claims, the following description setting forth in detail certain illustrative embodiments of the invention, these being indicative, however, of but a few of the various ways in which the principles of the invention may be employed.

DRAWINGS

In the appended drawings:

FIG. 1 is a broken away illustration of a conventional aerosol canister for use with the lachrymator solution of the present invention.

DETAILED DESCRIPTION

Figure 1:
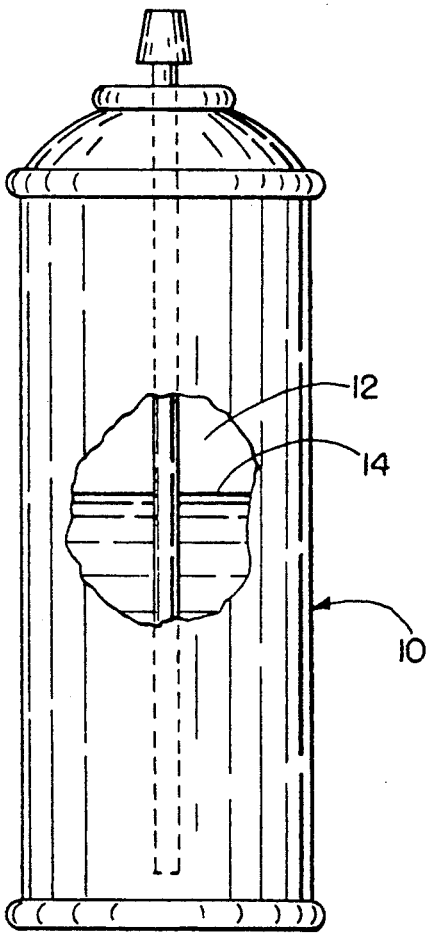

The lachrymator of the present invention is produced utilizing a mixture of a nonflammable carrier and capsicum. As used herein this specification and in the claims below the term "nonflammable" means having a flash point in excess of about 100° F. or an ignition point above 500° F.

In addition to being nonflammable, the carrier of the present invention should be suitable for use in a lachrymator. Specifically, the carrier is preferably substantially nontoxic (i.e., substantially free of chemicals classified as being toxic in the *Aldrich Catalog Handbook of Fine Chemicals* 1990–1991 which is distributed by Aldrich Chemical Company, Inc.). As used in this specification and the claims below the language "suitable for use in a lachrymator" means substantially free of chemicals classified in the *Aldrich Catalog Handbook of Fine Chemicals* 1990–1991 as being toxic. Preferably, the lachrymator and its carrier are nontoxic and thus contain no chemicals classified in the *Aldrich Catalog Handbook of Fine Chemicals* 1990–1991 as toxic.

Capsicum is commercially available in a form which is primarily geared for use by the food industry. More particularly, the capsicum is available in combination with soybean oil and in combination with propylene glycol.

The availability of capsicum in combination with soybean oil presented a problem. More particularly, applicants found that the soybean oil did not stay in solution to a sufficient extent when used in conjunction with certain carriers. However, applicants have found that the capsicum in combination with propylene glycol could be used in conjunction with other materials so as to provide a suitable nonflammable capsicum containing lachrymator.

Fortunately, the lachrymator made in accordance with the principles of the present invention may be utilized in any number of conventional pressurized aerosol spray containers or canisters. Such canisters are well-known and they comprise as shown in FIG. 1 a container 10 having a cavity 12 for storing the lachrymator solution 14 and a propellant (not shown) such as preferably nitrogen ($N_2$) gas for pressurizing the cavity.

In order to be properly utilized in a pressurized canister the carrier must be a liquid or a gas at room or ambient temperature (i.e., 70° F.) and one atmosphere of pressure (i.e., ambient pressure) and preferably it has a boiling point of less than about 225° F. in order to help ensure sufficient dispersion or distribution of the capsicum once the solution is dispensed from the pressurized canister. Additionally, the carrier must not solidify or freeze at temperatures as low as −10° F. and preferably as low as −20° F. Further, the carrier must be such that the components of the lachrymator solution do not separate or come out of solution over extended periods of time such as three days, preferably three weeks, and more preferably four weeks.

Applicants have found that a nonflammable carrier suitable for use in the present invention is a mixture of propylene glycol, ethyl alcohol and water. Accordingly, the invention provides a solution for use as a lachrymator comprising capsicum and a nonflammable carrier. The solution comprises from about 0.1 to about 0.8 percent by weight capsicum, from about 7 to about 23 percent by weight propylene glycol, from about 31 to about 39 percent by weight ethyl alcohol and from about 46 to about 54 percent by weight water. Preferably, the invention comprises from about 0.2 to about 0.4 percent by weight capsicum, from about 10 to about 18 percent by weight propylene glycol, from about 33 to about 37 percent by weight ethyl alcohol and from about 46 to about 54 percent by weight water. More preferably, the solution comprises about 0.3 percent by weight capsicum, about 14.7 percent by weight propylene glycol, about 35 percent by weight ethyl alcohol and about 50 percent by weight water.

An example of a capsicum and propylene glycol mixture suitable for use in the present invention is an oleoresin capsicum sold under the trade designation WS 500 by Kalsec, Inc. of Kalamazoo, Mich. 49005. This particular propylene glycol based oleoresin capsicum contains about 3.25 percent by weight capsicum rendering a mixture having a Scoville Unit (S.U.) of around 500,000. The Scoville Unit is derived utilizing a standard Scoville Heat Test as specified in Method 21.0 established by the American Spice Trade Association (ASTA).

An example of a suitable source of ethyl alcohol for use with the present invention is a denatured ethyl alcohol sold under the trade designation SDA-40-B by Midwest Grain Products, Inc. of Weston, Mo. 64098. SDA-40-B denatured ethyl alcohol contains about 99.9 percent by weight ethyl alcohol and about 0.1 percent by weight tertiary butyl alcohol and BITREX (denatonium benzoate).

An example of a suitable source of propylene glycol is a food grade propylene glycol USP available under the product code 70531 from the Dow Chemical Company of Midland, Mich. 48674.

The following examples will serve to illustrate the novel features and advantages of the present invention. While these examples will show one skilled in the art how to operate within the scope of this invention, they are not to serve as a limitation on the scope of the invention for such scope is only defined in the claims below.

In each of the examples, the stated components were mixed together in a glass beaker using a magnetic stir for a minimum of fifteen minutes prior to evaluation. Additionally, in the examples below the propylene glycol utilized is the Dow 70531 propylene glycol USP material, the oleoresin capsicum utilized is the Kalsec WS 500 and the ethyl alcohol utilized is Midwest's SDA-40-B. Further, all percentages set forth in the examples below are percents by weight.

EXAMPLE I

Components 50 grams propylene glycol (50%)
6 grams oleoresin capsicum (6%)
44 grams $H_2O$ (44%)

Remarks—After four days and freezing to −10° F. the mixture still did not separate. However, the viscosity of this material was such that the ability to provide adequate dispersion was questioned.

EXAMPLE II

Components 33 grams propylene glycol (33%)
11 grams oleoresin capsicum (11%)
56 grams $H_2O$ (56%)

Remarks—After four days and freezing to −10° F. the mixture still did not separate. However, once again the viscosity of the material was such that the ability to provide adequate dispersion was questioned.

EXAMPLE III

Components 25 grams propylene glycol (25%)
11 grams oleoresin capsicum (11%)
64 grams $H_2O$ (64%)

Remarks—After four days and freezing to −10° F. the mixture still did not separate. However, once again the ability to provide adequate dispersion was questioned.

EXAMPLE IV

Components 50 grams propylene glycol (50%)
6 grams oleoresin capsicum (6%)
44 grams $H_2O$ (44%)

Remarks—After 24 hours, oil is floating on the surface. The oil appeared incapable of remixing completely.

EXAMPLE V

Components 33 grams propylene glycol (33%)
11 grams oleoresin capsicum (11%)
56 grams $H_2O$ (56%)

Remarks—After 24 hours, oil is floating on the surface. The oil appeared incapable of remixing completely.

EXAMPLE VI

Components 25 grams propylene glycol (25%)
11 grams oleoresin capsicum (11%)
64 grams $H_2O$ (64%)

Remarks—After 24 hours, oil is floating on the surface. The oil appeared incapable of remixing completely.

EXAMPLE VII

Components 24 grams propylene glycol (24%)
6 grams oleoresin capsicum (6%)
35 grams ethyl alcohol (35%)
35 grams $H_2O$ (35%)

Remarks—Some separation of oil occurs on the surface after mixing.

EXAMPLE VIII

Components 20 grams propylene glycol (20%)
6 grams oleoresin capsicum (6%)

30 grams ethyl alcohol (30%)
44 grams $H_2O$ (44%)
Remarks—Some separation of oil occurs on the surface after mixing.

EXAMPLE IX

Components
44 grams propylene glycol (44%)
6 grams oleoresin capsicum (6%)
50 grams $H_2O$ (50%)
Remarks—Some separation of oil occurs on the surface after mixing.

EXAMPLE X

Components
20 grams propylene glycol (20%)
10 grams oleoresin capsicum (10%)
20 grams ethyl alcohol (20%)
50 grams $H_2O$ (50%)
Remarks—Settling occurs after three days. Shaking the batch remixes, but it remains cloudy.

EXAMPLE XI

Components
10 grams propylene glycol (10%)
10 grams oleoresin capsicum (10%)
30 grams ethyl alcohol (30%)
50 grams $H_2O$ (50%)
Remarks—Settling occurs after three days. Shaking the batch remixes, but it remains cloudy.

EXAMPLE XII

Components
10 grams propylene glycol (10%)
10 grams oleoresin capsicum (10%)
40 grams ethyl alcohol (40%)
40 grams $H_2O$ (40%)
Remarks—The mixture stays clear. However, it is believed that the flammability may be too high for some applications.

EXAMPLE XIII

Components
10 grams propylene glycol (10%)
10 grams oleoresin capsicum (10%)
35 grams ethyl alcohol (35%)
45 grams $H_2O$ (45%)
Remarks—Settling occurs after three days. Shaking the batch remixes, but it remains cloudy.

EXAMPLE XIV

Components
35 grams ethyl alcohol (35%)
10 grams oleoresin capsicum (10%)
55 grams $H_2O$ (55%)
Remarks—Settling occurs after three days. Shaking the batch remixes, but it remains cloudy.

EXAMPLE XV

Components
10 grams oleoresin capsicum (10%)
5 grams propylene glycol (5%)
35 grams ethyl alcohol (35%)
50 grams $H_2O$ (50%)
Remarks—No settling occurs in this formula after extended periods such as 40 days. The solution did not freeze when exposed to temperatures as low as −20° F. The solution is nonflammable and a liquid at ambient temperature and pressure with a boiling point of less than about 225° F. Dispersion of the solution through standard aerosol spray canisters displays very good knockdown effect and power.

While producing production quantities of the formulation set forth in Example XV preferably the formulation will be mixed in the proportions shown for a period of about one hour in 55 gallon drums utilizing mixers with collapsible mixing heads sold under the designation LIGHTNING NC4 by the Mixing Equipment Company of Rochester, N.Y. Thorough mixing is required in order to eliminate any separation of the components of the solution which would require additional mixing of the solution at a later time. Upon completion of the mixing step the solution should appear clear and homogenous when viewed with a flashlight.

It will be appreciated that although in the above example propylene glycol has been employed, the invention contemplates the use of other glycols such as, for example, polyethylene glycol.

Although the invention has been shown and described with respect to certain preferred embodiments, it is obvious that equivalent alterations and modifications will occur to others skilled in the art upon the reading and understanding of the specification. The present invention includes all such equivalent alternations and modifications, and is limited only by the scope of the following claims.

What is claimed is:

1. A canister for storing and applying a solution for use as a lachrymator comprising:
(A) a container having a cavity for storing said solution; and
(B) a propellant for pressurizing said cavity;
said solution comprising capsicum and a non flammable carrier, said nonflammable carrier containing no chlorofluorocarbons and having a boiling point of less than about 225° F., said solution comprising from about 0.2 weight percent to about 0.4 weight percent capsicum, from about 10 weight percent to about 18 weight percent glycol, from about 33 weight percent to about 37 weight percent ethyl alcohol and from about 46 weight percent to about 54 weight percent water.

2. A canister as set forth in claim 1 wherein said solution comprises about 0.3 weight percent capsicum.

3. A canister as set forth in claim 1 wherein said solution comprises about 14.7 weight percent glycol.

4. A canister as set forth in claim 1 wherein said solution comprises about 35 weight percent ethyl alcohol.

5. A canister as set forth in claim 1 wherein said solution comprises about 50 weight percent water.

6. A canister as set forth in claim 1 wherein said propellant comprises nitrogen ($N_2$).

7. A canister for storing and applying a solution for use as a lachrymator comprising:
(A) a container having a cavity for storing said solution; and
(B) a propellant for pressurizing said cavity, said propellant comprising nitrogen ($N_2$), said solution comprising capsicum and a nonflammable carrier having a boiling point of less than about 225° F., said solution comprising from about 0.2 weight percent to about 0.4 weight percent capsicum, from about 10 weight percent to about 18 weight percent glycol, from about 33 weight percent to about 37 weight percent ethyl alcohol and from about 46 weight percent to about 54 weight percent water.

8. A canister as set forth in claim 7 wherein said solution comprises about 0.3 weight percent capsicum.

9. A canister as set forth in claim 7 wherein said solution comprises about 14.7 weight percent glycol.

10. A canister as set forth in claim 7 wherein said solution comprises about 35 weight percent ethyl alcohol.

11. A canister as set forth in claim 7 wherein said solution comprises about 50 weight percent water.

* * * * *